US012102188B2

(12) United States Patent
Poulsen et al.

(10) Patent No.: US 12,102,188 B2
(45) **Date of Patent: *Oct. 1, 2024**

(54) UPPER FOR AN ARTICLE OF FOOTWEAR HAVING A TIE STRUCTURE

(71) Applicant: NIKE, Inc., Beaverton, OR (US)

(72) Inventors: Monica M. Poulsen, Beaverton, OR (US); Juan L. Aceves Tinajero, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/339,375

(22) Filed: Jun. 4, 2021

(65) Prior Publication Data

US 2021/0289888 A1 Sep. 23, 2021

Related U.S. Application Data

(63) Continuation of application No. 16/164,412, filed on Oct. 18, 2018, now Pat. No. 11,026,478.
(Continued)

(51) Int. Cl.

| | |
|---|---|
| ***A43C 1/04*** | (2006.01) |
| ***A43B 3/00*** | (2022.01) |
| ***A43B 3/24*** | (2006.01) |
| ***A43B 9/00*** | (2006.01) |
| ***A43B 23/02*** | (2006.01) |
| ***A43C 5/00*** | (2006.01) |

(52) U.S. Cl.
CPC ..... *A43C 1/04* (2013.01); *A43B 3/0036* (2013.01); *A43B 3/244* (2013.01); *A43B 9/00* (2013.01); *A43B 23/0245* (2013.01); *A43B 23/025* (2013.01); *A43B 23/0295* (2013.01); *A43C 5/00* (2013.01)

(58) Field of Classification Search
CPC ..... A43B 1/04; A43B 9/02; A43B 23/025; A43B 23/0295; A43B 3/244; A43C 1/04; A43C 5/00
See application file for complete search history.

(56) References Cited

U.S. PATENT DOCUMENTS

| | | | |
|---|---|---|---|
| 871,187 | A | 11/1907 | Saunders |
| 1,888,862 | A | 11/1932 | Mathews |

(Continued)

FOREIGN PATENT DOCUMENTS

| | | | |
|---|---|---|---|
| CN | 2432797 | Y | 6/2001 |
| CN | 206324316 | U | 7/2017 |
| GB | 684619 | A | 12/1952 |

OTHER PUBLICATIONS

Office Action received for European Patent Application No. 18800397.4, mailed on Jun. 9, 2023, 7 pages.

*Primary Examiner* — Sharon M Prange
(74) *Attorney, Agent, or Firm* — SHOOK, HARDY & BACON L.L.P.; Sarah Rieth

(57) ABSTRACT

An upper may be included with an article of footwear. The upper may include a textile portion, the textile portion forming a throat area of the upper. The upper may further include a base portion, the base portion extending to a biteline area of the upper. The upper may further include a tie structure, the tie structure extending through a first opening of the textile portion and a second opening of the base portion to secure the textile portion to the base portion.

20 Claims, 7 Drawing Sheets

Related U.S. Application Data

(60) Provisional application No. 62/575,115, filed on Oct. 20, 2017.

(56) References Cited

U.S. PATENT DOCUMENTS

| | | | | | |
|---|---|---|---|---|---|
| 2,119,392 | A | | 5/1938 | David | |
| 2,364,816 | A | | 12/1944 | Edward | |
| 2,541,020 | A | * | 2/1951 | Arnold | D04B 1/26 36/12 |
| 2,675,631 | A | | 4/1954 | Carr | |
| 2,679,117 | A | * | 5/1954 | Reed | A43B 3/14 D2/924 |
| 3,676,883 | A | | 7/1972 | Peacock | |
| 4,161,827 | A | | 7/1979 | Hogan et al. | |
| 5,463,822 | A | | 11/1995 | Miller | |
| 6,735,829 | B2 | | 5/2004 | Hsu | |
| 7,454,848 | B2 | | 11/2008 | Issler | |
| 7,987,617 | B2 | | 8/2011 | Kohatsu et al. | |
| 8,806,688 | B2 | * | 8/2014 | Edgeworth | A43B 3/30 36/12 |
| 9,629,418 | B2 | | 4/2017 | Rushbrook et al. | |
| 10,327,514 | B2 | | 6/2019 | Rhulen et al. | |
| 10,390,584 | B2 | | 8/2019 | Fuerst et al. | |
| 10,582,741 | B2 | | 3/2020 | Dombrow et al. | |
| 2013/0239438 | A1 | | 9/2013 | Shaffer et al. | |
| 2015/0020413 | A1 | | 1/2015 | Faggin et al. | |
| 2015/0257476 | A1 | | 9/2015 | Panian et al. | |
| 2016/0219983 | A1 | | 8/2016 | Taylor | |
| 2016/0286903 | A1 | | 10/2016 | Whewell et al. | |
| 2017/0027286 | A1 | | 2/2017 | Luedecke | |
| 2017/0202296 | A1 | | 7/2017 | Fuerst et al. | |
| 2019/0116936 | A1 | | 4/2019 | Aceves Tinajero et al. | |
| 2020/0187595 | A1 | | 6/2020 | Siegismund et al. | |

* cited by examiner

UPPER FOR AN ARTICLE OF FOOTWEAR HAVING A TIE STRUCTURE

CROSS-REFERENCE TO RELATED APPLICATIONS

This application, entitled "UPPER FOR AN ARTICLE OF FOOTWEAR HAVING A TIE STRUCTURE," is a continuation application of U.S. application Ser. No. 16/164,412, filed Oct. 18, 2018, and entitled "UPPER FOR AN ARTICLE OF FOOTWEAR HAVING A TIE STRUCTURE," which claims the benefit of priority of U.S. Provisional Application No. No. 62/575,115, filed Oct. 20, 2017, and entitled "UPPER FOR AN ARTICLE OF FOOTWEAR HAVING A TIE STRUCTURE." U.S. application Ser. No. 16/164,412 and U.S. Provisional Application No. 62/575,115 are incorporated herein by reference in their entirety.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot and in some instances under the foot. Access to the void in the interior of the upper is generally provided by an ankle opening in and/or adjacent to a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate other structures such as, for example, a heel counter to provide support and limit movement of the heel.

BRIEF DESCRIPTION OF THE DRAWINGS

The embodiments of the present disclosure may be better understood with reference to the following drawings and description. The components in the figures are not necessarily to scale, with emphasis instead being placed upon illustrating the principles of the present disclosure. Moreover, in the figures, like referenced numerals designate.

DETAILED DESCRIPTION

Figure 1:
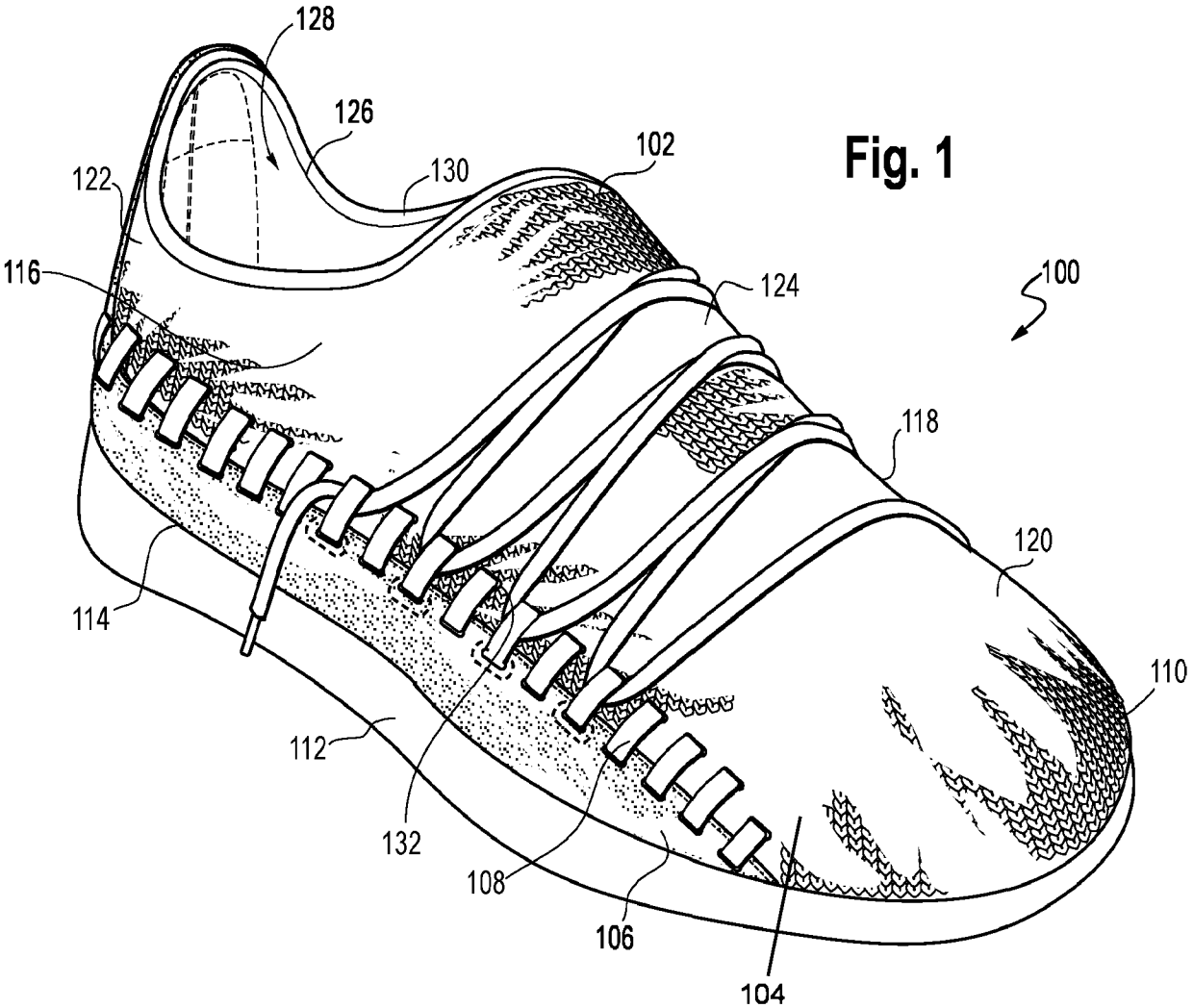
FIG. 1 is an illustration showing a perspective view of an embodiment of an article of footwear with a tie structure in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to uppers configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

In one aspect, the present disclosure relates to an upper for an article of footwear. The upper may include a textile portion, the textile portion forming a throat area of the upper. The upper may further include a base portion, the base portion extending to a biteline area of the upper. The upper may further include a tie structure, the tie structure extending through a first opening of the textile portion and a second opening of the base portion to secure the textile portion to the base portion.

In another aspect, the present disclosure relates to an article of footwear. The article of footwear may include a textile portion, the textile portion forming a throat area. The article of footwear may further include a base portion, the base portion being secured to, or formed integrally with, a sole structure. The article of footwear may further include a tie structure, the tie structure extending through an opening of the textile portion and an opening of the base portion to secure the tie structure with respect to the base portion.

In another aspect, the present disclosure relates to a method. The method may include forming a textile portion, the textile portion including a throat area of an upper for an article of footwear. The method may further include connecting the textile portion to a base portion by deploying a tie structure through at least one opening of the textile portion and at least one opening of a base portion, the base portion being secured to a sole structure.

Figure 2:
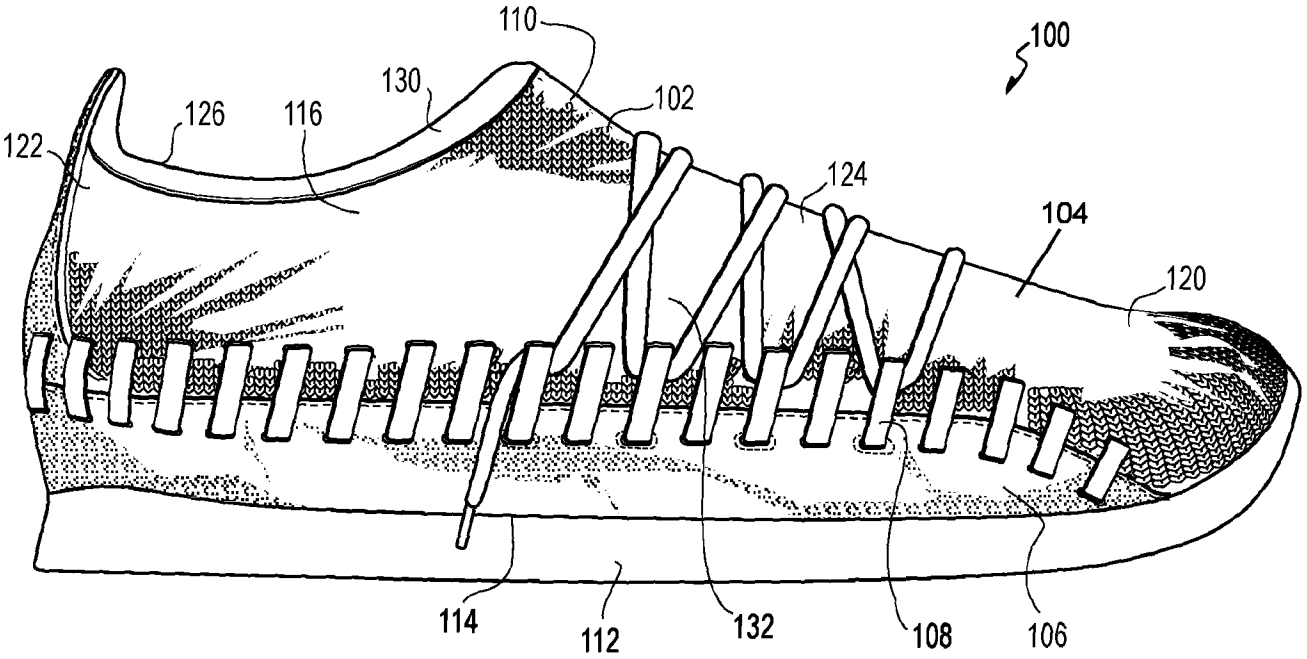
FIG. 2 is an illustration showing a side view of the article of footwear of FIG. 1.

FIG. 1 and FIG. 2 are illustrations showing a perspective view and a side view, respectively, of an article of footwear 100. Referring to FIGS. 1-2, and as described in more detail below, the article of footwear 100 may include an upper 102 with a first portion 104 and a second portion 106 (also referred to as a "base portion") connected via a fastening device, such as a tie structure 108. As shown, the base portion 106 of the upper 102 may be secured to a sole structure 112. The area where the sole structure 112 joins the upper 102 may be referred to as a biteline 114.

The upper 102 may be joined to the sole structure 112 in a fixed manner using any suitable technique, such as through the use of an adhesive, by sewing, etc. The upper 102 may extend partially or completely around a foot of a wearer (e.g., under the foot) and/or may be integral with the sole structure 112, and a sockliner may or may not be used. In some embodiments, the sole structure 112 may include a midsole and an outsole.

The upper 102 may include a lateral side 116, a medial side 118, a toe area 120, and a heel area 122. The upper 102 may additionally include a throat area 124 extending from an ankle opening 126 leading to a void 128, and a collar 130 may at least partially surround the ankle opening 126. The void 128 of the article of footwear 100 may be configured (e.g., sized and shaped) to receive and accommodate a foot of a person. The throat area 124 may be generally disposed in a midfoot area 132 of the upper 102, which may be located between the heel area 122 and a toe area 120. In some embodiments, a tongue may be disposed at least partially in the throat area 124. If the tongue is included, the tongue may be any type of tongue, such as a gusseted tongue or a burrito tongue. If a tongue is not included, the lateral and medial sides of the throat area 124 may be joined together.

The first portion 104 of the upper 102 (and/or the other portion(s)) may be formed at least partially with a knitted component 110, but a knitted component is optional, and the first portion 104 could alternatively or additionally include a textile component formed by a process other than knitting (e.g., weaving) and/or other materials, such as leather, plastic, rubber, etc. However, in non-limiting exemplary embodiments, forming the upper 102 with the knitted component 110 may provide the upper 102 with advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The knitted component 110 may also provide desirable aesthetic characteristics by incorporating yarns having different colors, textures or other visual properties arranged in a particular pattern.

Further, the yarns themselves and/or the knit structure of the knitted component 110 may be varied at different locations such that the knitted component 110 has two or more portions with different properties (e.g., a portion forming the throat area 124 of the upper 102 may be relatively elastic while another portion may be relatively inelastic). Additionally or alternatively, in some embodiments, the knitted component 110 may incorporate one or more materials with properties that change in response to a stimulus (e.g., temperature, moisture, electrical current, magnetic field, or light). For example, the knitted component 110 may include yarns formed of one or more thermoplastic polymer materials (including material composites) that transition from a solid state to a softened or liquid state when subjected to certain temperatures at or above the melting point and then transitions back to a solid state when cooled. The thermoplastic polymer material(s) may provide the ability to heat and then cool a portion of the knitted component 110 to thereby form an area of bonded or continuous material (herein referred to as a "fused area") that exhibits certain advantageous properties including a relatively high degree of rigidity, strength, and water resistance, for example. Non-limiting examples of thermoplastic polymer materials are polyurethanes, polyamides, polyolefins, and/or certain nylons.

As shown, the knitted component 110 may form the majority (or all) of the toe area 120 and the throat area 124, and the knitted component may extend to and around the heel area 122 of the upper 102. Advantageously, this orientation of the knitted component 110 may provide advantageous characteristics associated with knit to those areas, thus providing those areas with desirable weight, stretchability, breathability, etc. For example, by forming the throat area 124 with the knitted component 110, the throat area 124 may have a desirable elasticity/stretchability such that it stretches around the top (dorsal) surface of a foot of a user, thereby providing a snug, comfortable fit (which can be adjusted by tightening a fastening element over the foot's dorsal surface, for example). In some embodiments, certain areas of the knitted component 110 may have different knit structures, be formed of different yarn types, and/or may be processed differently during manufacturing such that different zones of the knitted component 110 have different properties. In some embodiments, for example, the throat area 124 may have a stretchability that is greater than a stretchability of the toe area 120.

The base portion 106 of the upper 102, which may be formed of a different material with different characteristics than the material of the knitted component 110, may extend to the biteline 114 of the upper 102 and may secure to the sole structure 112. The base portion 106 may be formed of any suitable material. For example, the base portion 106 may be formed of a leather, plastic, rubber, various textiles (e.g., fibers, filaments, or yarns that are, for example, either (a) produced directly from webs of fibers by bonding, fusing, or interlocking to construct non-woven fabrics and felts or (b) formed through a mechanical manipulation of yarn to produce a woven fabric), polymer sheets, combination(s) thereof, and/or any other suitable material. Optionally, the base portion 106 may be formed as second knitted component. When the base portion 106 is formed of a knitted component, the knit structure and/or the material used to form the base portion 106 may be selected such that the base portion is more rigid than the knitted component 110, thereby providing the article of footwear 100 with enhanced medial-to-lateral support when worn. Whether the base portion 106 is formed of a knitted component or another material, the rigidity of the base portion 106 may be greater than the rigidity of the knitted component 110 by at least 10%, 25%, 50%, 75%, 100%, 200%, 300%, 500%, or even 1000% (or more). The rigidity of the respective portions may be determined by applying an equal tension force (e.g., on a tensometer) and then measuring the relative and comparing the relative amounts of stretch/displacement. When one component stretches twice as much as the other upon subjection to the same force (e.g., such as 20 pounds of force, for example), it is said to have half the rigidity.

The base portion 106 may extend from the toe area 120 on a lateral side 116 of the article of footwear 100, around the heel area 122, and to the toe area 120 on the medial side. As shown, the base portion 106 may extend along the biteline 114, but in other embodiments, the base portion 106 may diverge from the biteline 114 in at least one location (e.g., if another portion and/or an opening is located between the sole structure 112 and the base portion 106).

Figure 3:
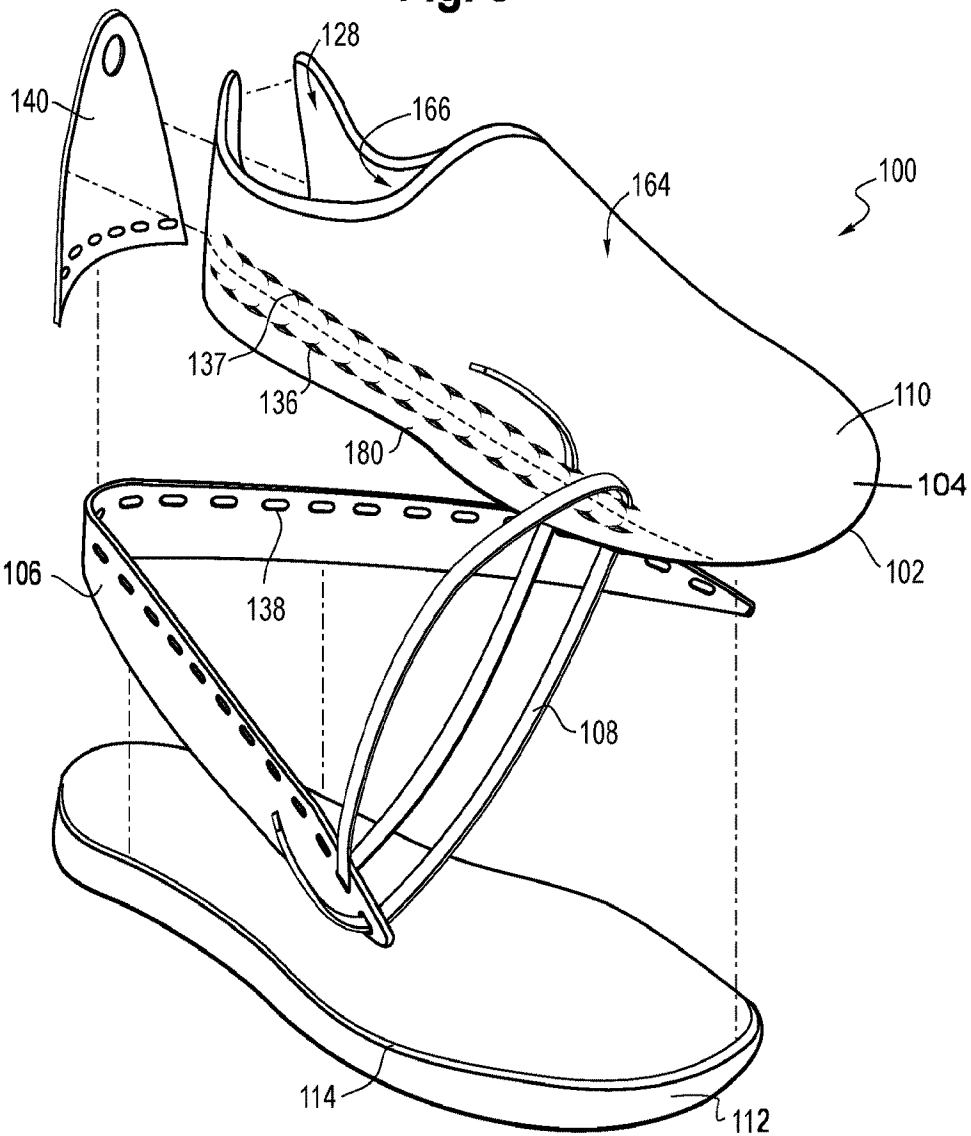
FIG. 3 is an illustration showing an exploded view of an embodiment of an article of footwear with a tie element in accordance with certain aspects of the present disclosure.

FIG. 3 is an illustration showing an exploded view of the article of footwear 100. As shown, at least one of the knitted component 110 and the base portion 106 may include an opening (here shown as the respective openings 136 and 138) for receiving the tie structure 108 or other fastening element. The opening 136 may be large enough such that it is larger than the cross section of the tie structure 108, the preventing the need to use excess force when deploying the tie structure 108 through the opening 136. In some embodiments, the knitted component 110 may have a first set of openings 136 that remain offset with respect to the openings 138 and a second set of openings 137 that align with the openings 138 when the article of footwear 102 is fully assembled. During manufacturing of the article of footwear 100, the tie structure 108 may be deployed through the openings 136, 137 and/or 138 and then tightened (e.g., by hand or by machine) to secure the knitted component 110 to the base portion 106. The tie structure 108 may be deployed before or after the base portion 106 is secured to the sole structure 112. For example, it may be advantageous for the base portion 106 to be secured to the sole structure 112 first (e.g., through use of an adhesive, by sewing, by stapling, etc.), and then later secured to the knitted component 110 via the tie structure 108. This order may be advantageous due to the ability of placing a foot-shaped last within the void 128 prior to installing the knitted component 110, which may help position the knitted component 110 correctly. In other embodiments, the tie structure 108 may be installed before or simultaneous to when the sole structure 112 is attached to the upper 102. Optionally, a third portion 140 may be installed before, during, or after installation of the tie structure 108. The third portion 140 is described in more detail below with reference to FIG. 8.

While the article of footwear 100 of FIG. 3 may be fully assembled during manufacturing, it is also contemplated that the knitted component 110 may be secured to the base portion 106 through deployment of the tie structure 108 by a consumer/user. Thus, the user could choose the components separately and then assemble them himself or herself. Additionally or alternatively, the user may be able to obtain multiple knitted components 110 and switch them by removing the tie structure 108 and then re-deploying it with a different knitted component 110. Advantageously, this may provide multiple footwear styles and/or multiple types of footwear at a relatively low cost.

The knitted component 110 may have an optional edge portion 180 that overlaps the base portion 106 when the article of footwear 100 is fully assembled. As a result, the edge portion 180 of the knitted component 110 may be coextensive with the base portion 106 at least at a location adjacent to where the base portion 106 and the knitted component 110 meet. Advantageously, the edge portion 180 may cover at least part of the base portion 106 from a perspective located inside the void 128, which may be advantageous when the knitted component 110 is better suited for contact with a user's foot (e.g., due to softness and other comfort-related characteristics of the knitted component 110, for example). In some embodiments, the edge portion 180 of the knitted component 110 may extend all the way to the biteline 114 (see FIG. 1) where the upper 102 joins the sole structure 112. It is further contemplated that the edge portion 180 may extend even beyond the biteline to form at least a portion of an underfoot surface.

The openings 136 in the knitted component 110 may be formed through any suitable process. In some embodiments, a piece of the knitted component may be cut away, punched away, or otherwise removed to form the opening 136. In other embodiments, the opening 136 may be formed by a particular structure of the knitted component 110. For example, during a knitting process on a flat knitting machine with at least one needle bed, one or more of needles of the needle bed(s) may be skipped while forming certain courses of the knitted component 110 such that a void is formed, and that void may eventually define the opening 136. Other suitable knit structures may additionally or alternatively be used to form the openings 136. When the openings 136 are formed by particular knit structures rather than by removing a portion of the knitted component 110 through cutting, punching, or another method, the openings 136 are said to be "knit-formed" in this disclosure.

The openings 136 shown in FIG. 3 may extend through the knitted component 110 from an outer surface 164 to an opposite-facing inner surface 166. When this is the case, a portion (not shown) of the tie structure 108 may be inside the void 128 once the article of footwear 100 is fully assembled. Optionally, padding or another protective element may be placed over that portion of the tie structure 108 if it irritates the foot of a user. In other embodiments, exposure of the foot to the portion of the tie structure 108 that is inside the void 128 may be allowed, particularly when the tie structure 108 is formed of a material and/or located at a particular spot that is not prone to irritating the foot.

Figure 4:
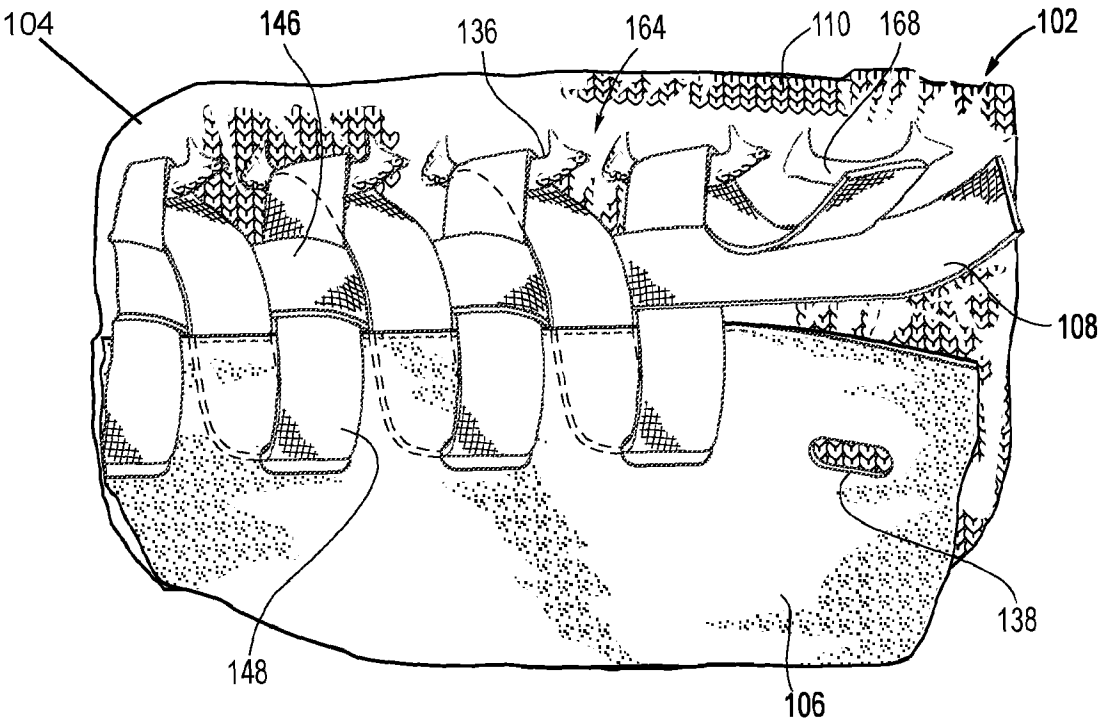
FIG. 4 is an illustration showing a portion of an upper with a knitted component secured to a base portion with a tie structure in accordance with certain aspects of the present disclosure.

FIG. 4 is an illustration showing a portion of the upper 102 having the tie structure 108 extending through openings 136 that are formed by surface loops 168. That is, instead of extending all the way through the knitted component 110 (as described above with reference to FIG. 3), the openings 136 may be formed through the surface loops 168 that extend from the outer surface 164 of the knitted component 110, as shown. In some embodiments, the surface loops 168 may be formed separately from the knitted component 110 (e.g., of a plastic or other suitable material) and then later attached, but in certain non-limiting exemplary embodiments, the surface loops 168 may be formed integrally with the remainder of the knitted component 110 through a knitting process. For example, the surface loops 168 may be at least partially formed by a yarn that also forms intermeshed loops defining the outer surface 164 (and/or the opposite inner surface). A similar structure and some of its advantages are described in detail in U.S. Provisional Patent Application No. 62/411,633, which is hereby incorporated by reference in its entirety.

As shown in FIG. 4, the tie structure 108 may extend such that it alternates between the openings 136 of the knitted component 110 and the openings 138 of the base portion 106 in a zig-zag style pattern. Optionally, a straight section 146 may extend beneath at least some of a plurality of segments 148, which may help retain tightness of the tie structure 108 and/or enhance the aesthetics of the tie structure 108. Other tie patters may additionally or alternatively be used (see, for example, the different tie structure of FIGS. 1-2 that lack the straight section 146 of FIG. 4). In some embodiments, the tie structure 108 may skip certain openings and then backtrack, thus forming a criss-cross pattern. In other embodiments, the tie structure 108 may have a football-style lacing pattern such that the segments 148 are straight (e.g., rather than zig-zagging as shown in FIG. 4). Further, in some embodiments, different portions of the tie structure 108 may have different tie patterns.

In the depicted embodiments, the tie structure 108 is formed as a continuous lace or other elongated strand of material. The tie structure 108 may be formed through braiding a plurality of yarns to form an elongated braided textile (e.g., in a manner similar to the formation of a certain shoelaces). The tie structure 108 may be additionally or alternatively be formed of other suitable materials and structures, such an elongated leather strip, an elongated strip formed of plastic or other composite material, a ribbon of silk, a metal wire, etc. Collectively, these elongated structures and similar structures are referred to herein as "laces." In exemplary embodiments, the tensile strength of the tie structure 108, or the maximum force that can be applied to the tie structure 108 before it breaks, may be at least 30 pounds, though in some embodiments the tensile strength may be much larger than that. For example, the tie structure 108 may be formed of a structure and material such that it can withstand a tensile force of at least 100 pounds, 200 pounds, 300 pounds, 400 pounds, or even 500 pounds or more.

As shown in FIG. 4, the tie structure 108 may be formed of a single elongated lace, but other tie structures are also contemplated. For example, each of segments extending between the openings 136 and 138 may be a separate lace (instead of a single continuous elongated lace). In other words, a plurality of separate segments or laces of the tie structure 108 may be physically separable before installation and may be deployed and tied (or otherwise secured) separately. The tie structure 108 is also not limited to laces. For instance, the tie structure 108 could instead (or additionally) be a series of clamps, staples, or other suitable connection devices.

Figure 5:
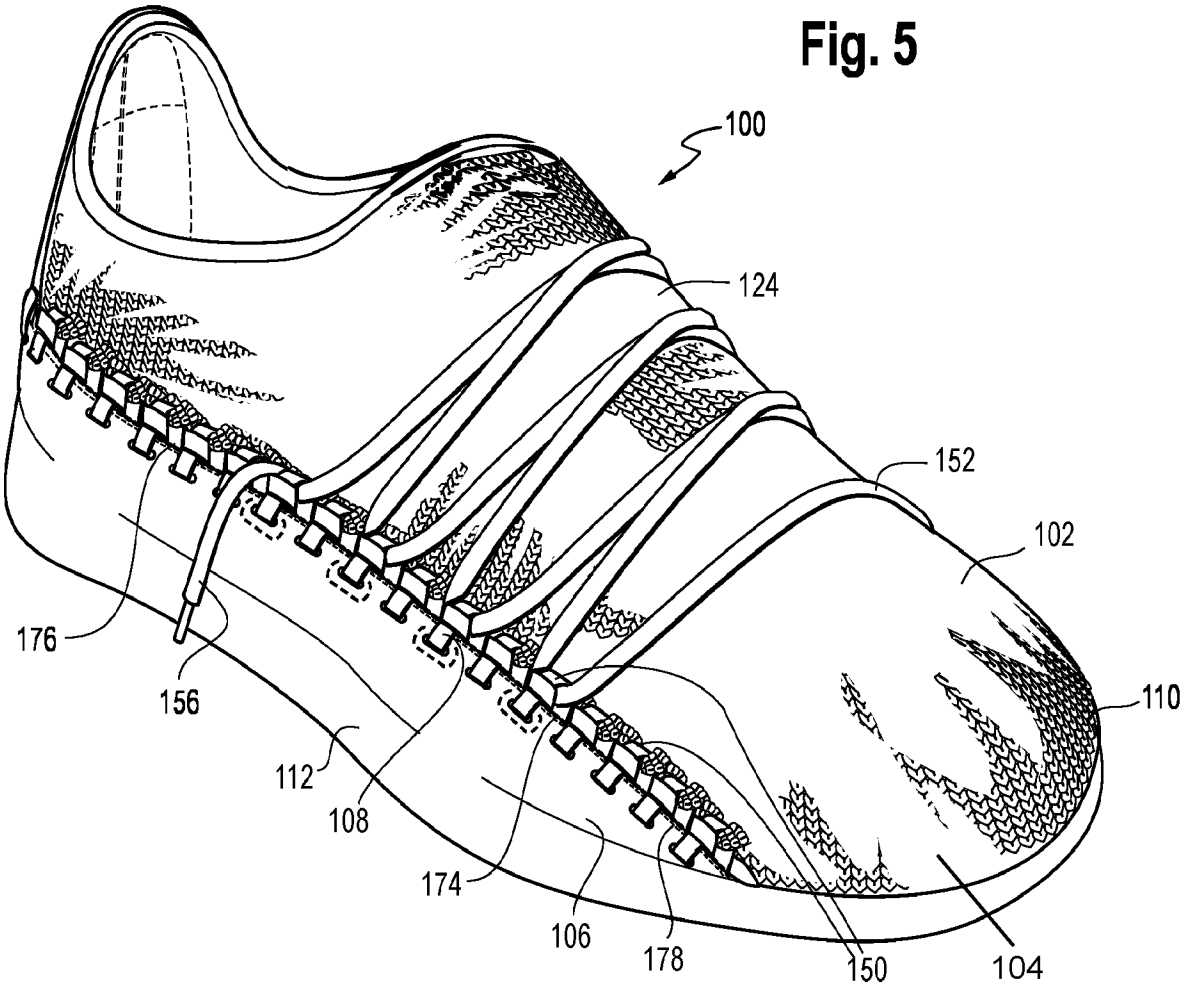
FIG. 5 is an illustration showing a perspective view of another embodiment of an article of footwear having a tie structure in accordance with the present disclosure.

FIG. 5 is an illustration showing a perspective view of the article of footwear 100 having a tie structure 108 with the pattern described with reference to FIG. 4. Referring to FIG. 5, the tie structure 108 may define one or more loops 150, which may be the same loops that extend through the openings of the knitted component 110, or not. The loops 150 may be configured (e.g., sized and shaped) for receiving a fastening element 152 (and it is noted that a similar feature is depicted with a different lacing patter in FIGS. 1-2). The fastening element 152 may include a common shoelace, for example. In some embodiments, the fastening element 152 may have a material and/or structure that is similar or identical to the tie structure 108, though this is not required in all embodiments. While not shown, it is contemplated that the same continuous strand of lace may form the tie structure 108 and the fastening element 152 (e.g., where the lace forming the tie structure 108 has at least one portion extending over the throat area 124, for example). In other embodiments, the fastening element 152 include something other than a lace, such as a cable-tensioning system, a Velcro strap, and/or any other suitable device. The loops 150 may be configured to secure to and communicate with the fastening element 152 such that the fastening element 152 can facilitate adjustment of the upper 102 around a foot.

The loops 150 may be a particular size, and/or the materials of the tie structure 108 and fastening element 152 many have a suitable friction, such that the fastening element 152 can slide/move with respect to the loops 150 when a user pulls on an end 156 of the fastening element 152. In some embodiments, for example, at least one of the tie structure 108 and the fastening element 152 may have a relatively smooth outer surface (e.g., formed of a plastic or wax) for providing a relatively-low friction.

Figure 7:
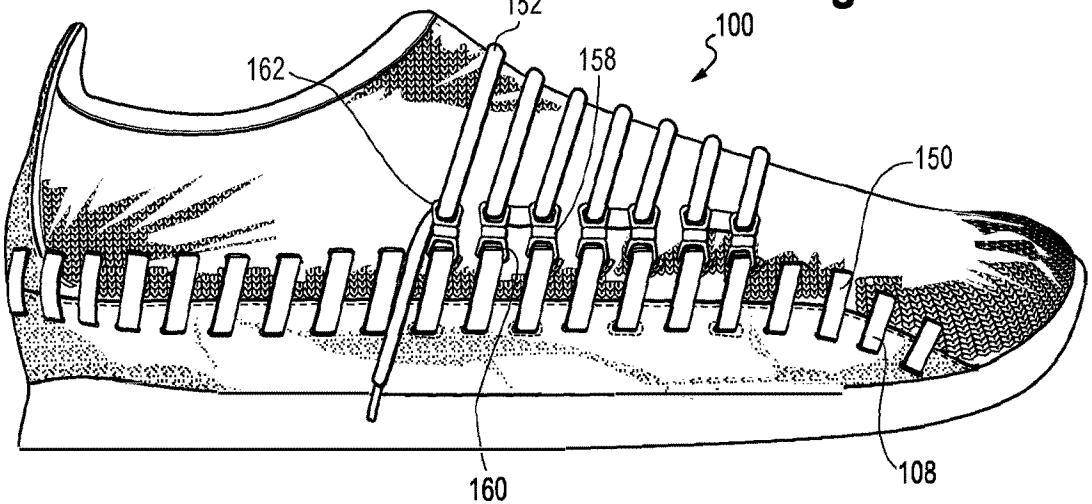
FIG. 7 is an illustration showing a side view of another embodiment of an article of footwear having a grommet in accordance with certain aspects of the present disclosure.

The loops 150 may be located at any suitable location for compatibility with the fastening element 152, and it is contemplated that the tie structure 108 may provide a user with the capability of choosing which loops 150 to use. For example, when a certain situation calls for it, the fastening element 152 may be deployed such that each consecutive loop 150 of a series of loops 150 engages the fastening element 152 (similar to as shown in FIG. 7). In other situations, including the depicted situation in FIG. 5, at least one loop 150, such as every other loop 150, is skipped by the fastening element 152. In other words, every other loop 150 may engage the fastening element 152, and the skipped loops 150 may remain spaced from (and out of contact with) the fastening element 152. Other orientations are also possible (e.g., skipping two, three, four, five, or more of the loops 150 at a certain location). Advantageously, a manufacturer and/or a user can deploy the fastening element 152 for personal taste and/or a particular activity without substantially changing the structure of the upper 102. Advantageously, certain common manufacturing processes may be utilized to form articles of footwear designed for different purposes or different personal tastes, thus increasing manufacturing efficiency and reducing the end costs of products going to the consumer.

As shown in FIG. 5, the knitted component 110 and the base portion 106 may be additionally (or alternatively) secured together at a sewn seam 174 (or other type of seam) that extends along a terminal edge 176 of the base portion 106. Advantageously, the seam 174 may keep the edge 176 of the base portion 106 in close engagement with the knitted component 110 to prevent snagging and collection of dirt or other particles between the knitted component 110 and base portion 106 during normal use. The seam 174 may additionally enhance the strength of the attachment between the knitted component 110 and the base portion 106. While any suitable structure may be used, the seam 174 may be formed with a sewing thread 178, which many be any suitable thread type (e.g., a strand of nylon, polyester, and/or another fiber, a metal wire, a monofilament yarn, etc.). In non-limiting exemplary embodiments, a diameter of the thread 178 is substantially smaller (e.g., at least three times smaller) than a diameter or other cross-section of the tie structure 108, which may be advantageous since the relatively-small thread 178 does not inhibit the tie pattern of the tie structure 108. Optionally, the thread 178 of the seam 174 may also extend through the tie structure 108 such that the tie structure 108 is sewn to at least one of the knitted component 110 and the base portion 106. This may secure the tie structure 108 in place once it is deployed to prevent the tie structure 108 from snagging, collecting debris beneath the tie structure 108, etc. Additionally or alternatively, a different fastening device may be used in conjunction with the tie structure 108, such as an adhesive between the tie structure 108 and the knitted component 110 and/or base portion 106, for example. In another embodiment, at least one of the knitted component 110, base portion 106, and tie structure 108 may include a thermoplastic polymer material (e.g., included in a yarn), where after being subjected to a heating process and then cooled, the tie structure 108 is at least partially fused to the base portion 106 and/or the knitted component 110. In other embodiments, the tie pattern of the tie structure 108 may be sufficient on its own and no secondary securement device is necessary.

As shown in FIG. 5, in certain embodiments, the base portion 106 may optionally be formed integrally with the sole structure 112. In other words, the material of the sole structure 112 itself may extend upward beyond the typical location of a biteline to form the base portion 106. Advantageously, the integral base portion 106 and sole structure 112 may enhance the medial-to-lateral support provided to a user and also the durability of the article of footwear 100 with respect to certain other embodiments.

Figure 6:
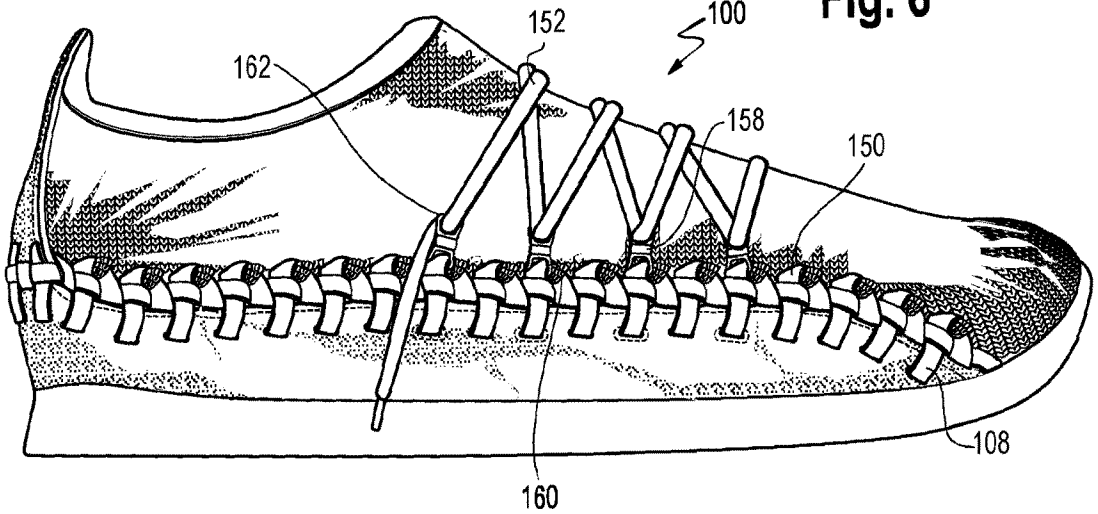
FIG. 6 is an illustration showing a side view of an embodiment of an article of footwear having a grommet in accordance with certain aspects of the present disclosure.

FIGS. 6-7 are illustrations showing a side view of the article of footwear 100 having grommets 158. In some embodiments, at least one grommet 158 may be coupled to at least one of the loops 150 formed by the tie structure 108. The grommet 158 may be formed from any suitable material (e.g., a metal, a plastic, or even a textile). While any suitable structure is contemplated, the grommet 158 may have first opening 160 for receiving the tie structure 108 and a second opening 162 for receiving the fastening element 152. The grommets 158 may be posited in engagement with any or all of the loops 150. For example, as shown in FIG. 7, a series of grommets 158 may be in engagement with each consecutive loop 150 of a certain series, as shown. In other embodiments, such as that of FIG. 6, certain loops 150 of the series may be skipped and lack a grommet 158. Advantageously, the grommets 158 may be positioned for suitable interaction with the fastening element 152 (and different organizations may be suitable for different fastening elements). In some embodiments the positioning of the grommets 158 may be customized for a particular user and/or activity.

The grommets 158 may be advantageous when the tie structure 108 is tied tight enough where it is difficult to lace the fastening element 152 through the loops 150, and/or when the friction coefficient between the loops 150 and the fastening element 152 is less desirable than the friction coefficient between the fastening element 152 and the grommets 158. In certain embodiments, some loops 150 may communicate with the fastening element 152 directly (e.g., without a grommet 158), and other loops 150 may communicate with the fastening element 152 through a grommet 158. In this disclosure, loops 150 are said to be "coupled" with the fastening element 152 whether that coupling is accomplished directly or through a grommet 158.

Optionally, the grommets 158 may be removable by a user. For example, the first opening 160 of the grommets 158 may be hook-shaped or include an openable clip such that, when desired, the user can disengage the grommets 158 from the loops 150 (e.g., to remove them, move them to different loop, etc.). In other embodiments, the grommets 158 may be configured such that they are difficult or impossible to remove during normal use of the article of footwear 100, which may be advantageous when losing the grommets 158 is a concern. However, even when the grommets 158 are not designed to be removed and/or moved by a user, they may still be selectively placed on certain loops 150 during footwear manufacturing (either in a standard or customized fashion), thus potentially providing multiple footwear types using similar elements and manufacturing techniques.

Figure 8:
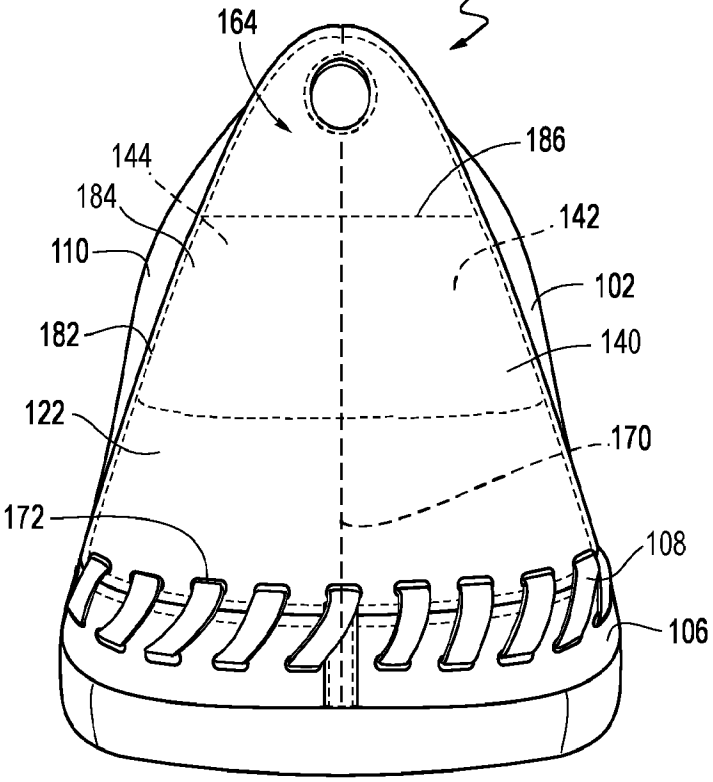
FIG. 8 is an illustration showing a back view of an article of footwear having a third portion in accordance with certain aspects of the present disclosure.

FIG. 8 is an illustration showing a back view of the article of footwear 100. As shown, the third portion 140 may be secured to the knitted component 110. The third portion 140 may be formed of any suitable material, such as a textile (e.g., a knitted component), leather, plastic, rubber, and/or any other suitable material. In some embodiments, including the depicted embodiment, at least part of the third portion 140 may be coextensive with the knitted component 110 when the article of footwear 100 is fully assembled, thus providing an additional layer of support and protection at a particular location. While not shown, it is also contemplated that at least part of the third portion 140 may extend beyond a boundary of the knitted component 110 such that it includes a free section (i.e., a section that is not coextensive with the knitted component 110).

The third portion 140 may form at least a portion of the outer surface 164 of the upper 102, as shown, and it is also contemplated that the third portion 140 may additionally or alternatively form a surface within the void of the article of footwear 100. While the third portion 140 may be positioned in any suitable location, it may be particularly advantageous to locate the third portion 140 in the heel area 122 (e.g., behind the heel), as shown, to provide additional heel support to the article of footwear 100. Additionally or alternatively, the heel area 122 may cover a seam 170 connecting the lateral heel portion 142 of the knitted component 110 with the medial heel portion 144 of the knitted component 110, thus increasing the durability of the heel area 122. In other embodiments, the third portion 140 (and/or other additional portions) may be located at any other suitable location, such as on the medial and/or lateral sides of the upper 102 in the midfoot area, in the toe area and/or throat area of the upper 102, etc.

The third portion 140 may be secured to the rest of the upper 102 in any suitable manner. For example, as shown, the third portion 140 may be secured to the knitted component 110, and/or the base portion 106, via the tie structure 108. To communicate with the tie structure 108, the third portion 140 may include at least one opening 172 for receiving the tie structure 108. When the third portion 140 is a knitted component, the openings 172 of the base portion 106 may be knit-formed openings of suitable size, but any other suitable structure and method for forming the openings is also contemplated. The openings 172 of the third portion 140 may align with openings of the knitted component 110 and/or the base portion 106, which may simplify the deployment/installation of the tie structure 108 with respect to other embodiments.

A sewn seam 182 (or other connection) may extend along at least a portion of an edge 184 of the third portion 140 to secure the third portion 140 to the knitted component 110. The sewn seam 182 may additionally extend in a location other than adjacent to the edge 184, such as through a central area 186 of the third portion 140, to enhance the securement of the third portion 140 and to keep the inner surface of the third portion 140 flush with the outer surface of the knitted component 110. While not shown, the sewn seam 182 may additionally extend through a component located between the third portion 140 and the knitted component 110, such as a cushioning element, to fix it in its desired location with respect to the rest of the upper 102.

All of the structures and methods disclosed and claimed herein can be made and executed without undue experimentation in light of the present disclosure. While this invention may be embodied in many different forms, there are described in detail herein specific aspects of the invention. The present disclosure is an exemplification of the principles of the invention and is not intended to limit the invention to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various aspects described herein. It should also be understood that various changes and modifications to the aspects described herein will be apparent to those skilled in the art. Such changes and modifications can be made without departing from the spirit and scope of the invention and without diminishing its intended advantages. It is therefore intended that such changes and modifications be covered by the appended claims.

The invention claimed is:

1. An upper for an article of footwear comprising:

a textile portion having a first set of openings, the textile portion at least partially forming a throat area of the upper;

a knit base portion having a second set of openings, the knit base portion extending from a biteline area of the upper towards the throat area of the upper;

an edge portion extending downward from the textile portion and overlapping the knit base portion, the edge portion comprising a third set of openings positioned below the first set of openings in the textile portion; and a tie structure, the tie structure extending through the first set of openings, the second set of openings, and the third set of openings to secure the textile portion and the edge portion to the knit base portion at a location between the throat area of the upper and the biteline area of the upper, wherein the textile portion and the knit base portion are additionally secured via a sewn seam, wherein the sewn seam extends along the edge portion.

2. The upper of claim 1, wherein the tie structure defines a loop adjacent to the textile portion, and wherein the loop forms an aperture for receiving a fastening element.

3. The upper of claim 1 further comprising a grommet coupled to a loop formed by the tie structure, wherein the grommet forms an aperture for receiving a fastening element.

4. The upper of claim 1, wherein the textile portion comprise a first portion and the knit base portion comprises a second portion, the upper further comprising a third portion secured to the textile portion via the tie structure, wherein the third portion forms an outer surface of the upper in a heel area, and wherein the tie structure is located between the third portion and the base portion.

5. The upper of claim 1, wherein the textile portion extends to the biteline area of the upper such that the textile portion and the knit base portion overlap at a location adjacent to the biteline area.

6. The upper of claim 1, wherein the tie structure extends from a medial side of the upper, through a heel area of the upper, and to a lateral side of the upper.

7. The upper of claim 1, wherein the upper is integrated into the article of footwear.

8. An upper for an article of footwear comprising:

a textile portion having a first set of openings, the textile portion at least partially forming a throat area of the upper;

a knit base portion having a second set of openings, the knit base portion extending from a biteline area of the upper towards the throat area of the upper;

an edge portion extending downward from the textile portion and overlapping the knit base portion, the edge portion comprising a third set of openings positioned below the first set of openings in the textile portion; and a tie structure, the tie structure extending through the first set of openings, the second set of openings, and the third set of openings to secure the textile portion to the knit base portion, wherein the tie structure extends continuously from a medial side of the article of footwear, through a heel area of the article of footwear, and to a lateral side of the article of footwear, and wherein a grommet is coupled to a loop formed by the tie structure, wherein the grommet forms an aperture for receiving a fastening element.

9. The upper of claim 8, wherein the tie structure defines the loop adjacent to the textile portion.

10. The upper of claim 8, wherein the textile portion is a knitted component.

11. The upper of claim 8, wherein the tie structure includes at least one straight section that extends beneath at least one segment of the tie structure from an external perspective.

12. The upper of claim 8, wherein the upper is integrated into the article of footwear.

13. An article of footwear comprising:

an upper comprising a throat area and a biteline area;

a textile portion having a first set of openings, the textile portion at least partially forming the throat area of the upper;

a knit base portion having a second set of openings, the knit base portion extending from the biteline area of the upper towards the throat area of the upper;

an edge portion extending downward from the textile portion and overlapping the knit base portion, the edge portion comprising a third set of openings positioned below the first set of openings in the textile portion; and a tie structure extending through the first set of openings, the second set of openings, and the third set of openings to secure the textile portion and the edge portion to the knit base portion, wherein the textile portion, the tie structure, and the knit base portion are additionally secured with an adhesive.

14. The article of footwear of claim 13, wherein the tie structure defines a loop adjacent to the textile portion, and wherein the loop forms an aperture for receiving a fastening element.

15. The article of footwear of claim 13, further comprising a grommet coupled to a loop formed by the tie structure, wherein the grommet forms an aperture for receiving a fastening element.

16. The article of footwear of claim 13, wherein the textile portion and the knit base portion are additionally secured via a sewn seam, wherein the sewn seam extends along an edge of the knit base portion.

17. The article of footwear of claim 13, wherein the textile portion extends to the biteline area such that the textile portion and the knit base portion overlap at a location adjacent to the biteline area.

18. The article of footwear of claim 13 further comprising a medial side, a lateral side, and a heel area, wherein the tie structure extends from the medial side, through the heel area, and to the lateral side.

19. The article of footwear of claim 13 further comprising a sole structure, wherein the sole structure is secured to, or integrally formed with, the knit base portion.

20. The article of footwear of claim 13 further comprising a toe area and a heel area, wherein the tie structure extends from the toe area towards the heel area.

* * * * *